US007181940B2

(12) United States Patent
Lin

(10) Patent No.: US 7,181,940 B2
(45) Date of Patent: Feb. 27, 2007

(54) DOOR LOCK TRANSMISSION MECHANISM

(75) Inventor: Ching-Tien Lin, Xinzhuang (TW)

(73) Assignee: Thase Enterprise Co., Ltd., Xinzhuang (TW)

( * ) Notice: Subject to any disclaimer, the term of this patent is extended or adjusted under 35 U.S.C. 154(b) by 129 days.

(21) Appl. No.: 10/986,215

(22) Filed: Nov. 12, 2004

(65) Prior Publication Data

US 2005/0257583 A1 Nov. 24, 2005

(30) Foreign Application Priority Data

May 21, 2004 (TW) ..... 93208086 U

(51) Int. Cl.
*E05B 55/04* (2006.01)
*E05B 65/10* (2006.01)

(52) U.S. Cl. ..... 70/472; 70/92

(58) Field of Classification Search ..... 70/472, 70/218, 221–224, 134; 292/92
See application file for complete search history.

(56) References Cited

U.S. PATENT DOCUMENTS 3,990,277 A * 11/1976 Mullich ..... 70/107
4,838,053 A * 6/1989 Shen ..... 70/92
4,920,773 A * 5/1990 Surko, Jr. ..... 70/224
5,881,586 A * 3/1999 Shen ..... 70/107
5,992,195 A * 11/1999 Huang et al. ..... 70/472
6,581,423 B2 * 6/2003 Lin ..... 70/107
6,622,535 B2 * 9/2003 Chiang et al. ..... 70/107
6,993,946 B1 * 2/2006 Shen ..... 70/472

FOREIGN PATENT DOCUMENTS

| | | |
|---|---|---|
| TW | 414242 | 12/2000 |
| TW | 486011 | 5/2002 |
| TW | 572102 | 1/2004 |

* cited by examiner

*Primary Examiner*—Brian E. Glessner
*Assistant Examiner*—Kristina R Gluchowski
(74) *Attorney, Agent, or Firm*—Shoemaker and Mattare

(57) ABSTRACT

A door lock transmission mechanism is provided on the first surface of a door for transmitting movement to a door lock provided on the second surface of the door opposite to the first surface. The door lock transmission mechanism includes a lock casing unit, an actuation mechanism, and a locking mechanism. The actuation mechanism includes a traction member having a traction portion for driving a locking seat of a core unit of the locking mechanism, wherein the locking seat can rotate freely when the locking mechanism is locked, such that an actuation member of the actuation mechanism can be pressed down by force and keeps the locking state of the door lock, and thus the parts of the door lock transmission mechanism can be protected from being damaged.

19 Claims, 10 Drawing Sheets

DOOR LOCK TRANSMISSION MECHANISM

FIELD OF THE INVENTION

The present invention relates to a door lock transmission mechanism, and more particularly, to a door lock transmission mechanism provided on one side of a door for transmitting movement to a door lock provided on the other side of the door to open the door.

BACKGROUND OF THE INVENTION

A general fire-blocking door lock structure is installed on one side of a fire-blocking door, with a frame member horizontally mounted on the center of the fire-blocking door. By pushing a push plate contained within the frame member, a mechanism inside a door lock casing unit is driven to move downwardly, causing a latch to be drawn back to release the locking state of the door lock, thereby opening the door.

Moreover, a door lock transmission mechanism which comprises a handle bar (or a push plate) and/or a lock barrel is installed on the other side of the door. Users can unlatch the fire-blocking door lock to open the door from the other side of the door by pushing the handle bar or the push plate, or inserting a key into the lock barrel. Furthermore, the key inserted into the lock barrel can also lock the fire-blocking door lock, in order to prevent unauthorized people or burglars from entering. The foregoing conventional door lock transmission mechanism has been disclosed in Taiwan Patent No. 486011 and No. 414242.

However, when the fire-blocking door lock according to such patents is locked, an actuating member, such as the handle bar or the push plate, is caught and fixed with inner parts of the door lock transmission mechanism. in other words, when the fire-blocking door lock is locked by a key, the handle bar or the push plate can not be pressed down by users. Therefore, if the handle bar or the push plate is malevolently struck, the inner parts of the door lock transmission mechanism and the assembly structure thereof may be damaged. Accordingly, while such conventional door lock transmission mechanism is locked, the parts of the door lock transmission mechanism and the assembly structure thereof may easily fail to function due to the aforementioned vulnerability.

Meanwhile, because the parts of the conventional door lock transmission mechanism and the assembly structure thereof may be easily damaged, higher maintenance costs and more maintenance time result. Moreover, because of the high failure rate of such door lock transmission mechanism, the operational efficiency of the door lock may be reduced, thereby adversely affecting operation. Therefore, said conventional door lock transmission mechanism is not only disadvantageous in terms of maintenance and operation, but also inclined to influence the normal safety function of the fire-blocking door lock due to the operational problems.

Furthermore, due to the lack of flexibility of the structural design of the foregoing conventional door lock transmission mechanism, said door lock transmission mechanism can only be applied to specific fire-blocking door locks compatible with its design principles. Therefore, the application of the conventional door lock transmission mechanism is restricted to only a few types of fire-blocking door locks, lacking applicability to many types of fire-blocking door locks.

From the foregoing description, because the handle bar or the push plate of said conventional door lock transmission mechanism is easily damaged by excess external force, not only the problems of maintenance, cost, and operation may be induced, but also the effective actuation of the fire-blocking door lock may be obstructed by vulnerable parts of the door lock transmission mechanism, so that users may be endangered. Accordingly, said conventional door lock transmission mechanism has drawbacks, making an alternative design desirable.

SUMMARY OF THE INVENTION

In view of the drawbacks of said prior techniques, an objective of the present invention is to provide a door lock transmission mechanism by which a locking state can be kept, in which a handle bar or a push plate can be forcibly pressed while the door lock is locked, so that the parts of the door lock transmission mechanism can be protected from damage.

Another objective of the present invention is to provide a door lock transmission mechanism which can actuate a fire-blocking door lock effectively and keep the door lock in a locked state securely.

Another objective of the present invention is to provide a door lock transmission mechanism, wherein the maintenance time for the door lock can be shortened and the maintenance cost of the door lock can also be reduced by adopting this door lock transmission mechanism.

Another objective of the present invention is to provide a door lock transmission mechanism with a flexible structural design able to be adopted in various types of door locks.

In accordance with the above and other objectives, the present invention proposes a door lock transmission mechanism provided on the first surface of a door for driving a door lock provided on the second surface of the door, wherein the second surface is opposite to the first surface. The door lock transmission mechanism at least comprises a door lock casing unit, an actuation mechanism, and a locking mechanism.

In one embodiment of the present invention, the door lock casing unit is mounted on the first surface of the door. The door lock casing unit mainly comprises a panel and a base frame provided within the panel, wherein the base frame has a plurality of tacking studs for screwing assembling rods for connecting the door lock casing unit with the door lock.

The actuation mechanism comprises: an actuation member provided outside the door lock casing unit having an actuation portion, a swivel table provided inside the door lock casing unit and actuated by the actuation portion, and a traction member partially covering the swivel table and driven by the swivel table having a traction portion.

The locking mechanism comprises a core unit, a locking plate, a lock barrel driving plate, and a lock barrel. The core unit is provided in one side of the traction member away from the swivel table, and at least comprises a swivel block and a locking seat, wherein the locking seat can retractably catch the swivel block to actuate the door lock. The locking plate is connected to one end of the core unit away from the traction member by elastic members. The lock barrel driving plate for pushing the locking plate is provide in one side of the locking plated away from the core unit. The lock barrel for driving the lock barrel driving plate away from one side of the locking plate is inserted into the door lock casing unit. The core unit further comprises a core fixing plate fixed inside the door lock casing unit with a plurality of extension portions for mounting the elastic members.

When the locking mechanism is in a locked state, the swivel block is not caught in the locking seat and can swivel freely. When the locking mechanism is unlocked, the swivel block is caught in the locking seat, and hence the shaft which is fixed with the swivel block and connected to the door lock can be rotated. By this way, when the door lock is locked, the locking state can be kept, even if the actuation member is pressed, due to the fact that the swivel block may freely swivel.

In another embodiment of the present invention, the door lock casing unit is provided on the first surface of the door, and the actuation mechanism can be selected to comprise: an actuation member provided outside the door lock casing unit with an actuation portion penetrating into the inner side of the door lock casing unit, a pair of fixing pieces provided inside the door lock casing unit in which the actuation portion can be caught in a rotatable way, and a traction member provided in one side of the fixing pieces which is actuated by the actuation portion. The traction member comprises a traction portion and a transmission portion wherein the transmission portion is provided in the opposite end of the traction portion. The two sides of the actuation portion of the actuation member are connected to a pair of pivot pins, such that the actuation portion can catch in the fixing pieces in a rotatable way.

The locking mechanism comprises: a core unit provided in one side of the traction member away from the fixing pieces, which at least includes a swivel block and a locking seat wherein the locking seat can retractably catch the swivel block; a locking plate connected to one side of the core unit away from the traction member by elastic members; a lock barrel driving plate provided in one side of the locking plate away from the core unit for driving the locking plate; and a lock barrel inserted through the outer surface of the door lock casing unit, for driving the lock barrel driving plate away from one side of the locking plate.

In this embodiment, as in the first embodiment, the locking seat of the core unit can rotate freely when the door lock is locked up, so that the actuation member can be pressed down without releasing the locked state of the door lock.

Since the locking seat of the core unit can rotate freely, when the door lock is locked, users can press down the actuation member and the locked state can still be maintained. Therefore, the elements of the door lock transmission mechanism are free from damage. By this way, the drawbacks of the conventional techniques, such as the problems that the inner parts of the door lock transmission mechanism may be damaged while the handle bar or the push plate is malevolently stuck, can be resolved by the present invention.

Meanwhile, because the door lock transmission mechanism according to the present invention is without the problem that the door lock is easily damaged as in prior art, the fire-blocking door lock can be operated effectively, and hence, both maintenance time and maintenance cost can be reduced. In addition, since there is a plurality of tacking studs on the base frame for screwing the assembling rods, the door lock transmission mechanism according to the present invention has a flexible structural design for being applied to various kinds of door locks while satisfying the related rules, and is practical in industrial application.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE EMBODIMENTS

The following detailed description of the embodiments is to further explain the present invention, not to restrict the present invention.

First Embodiment

Figure 1:
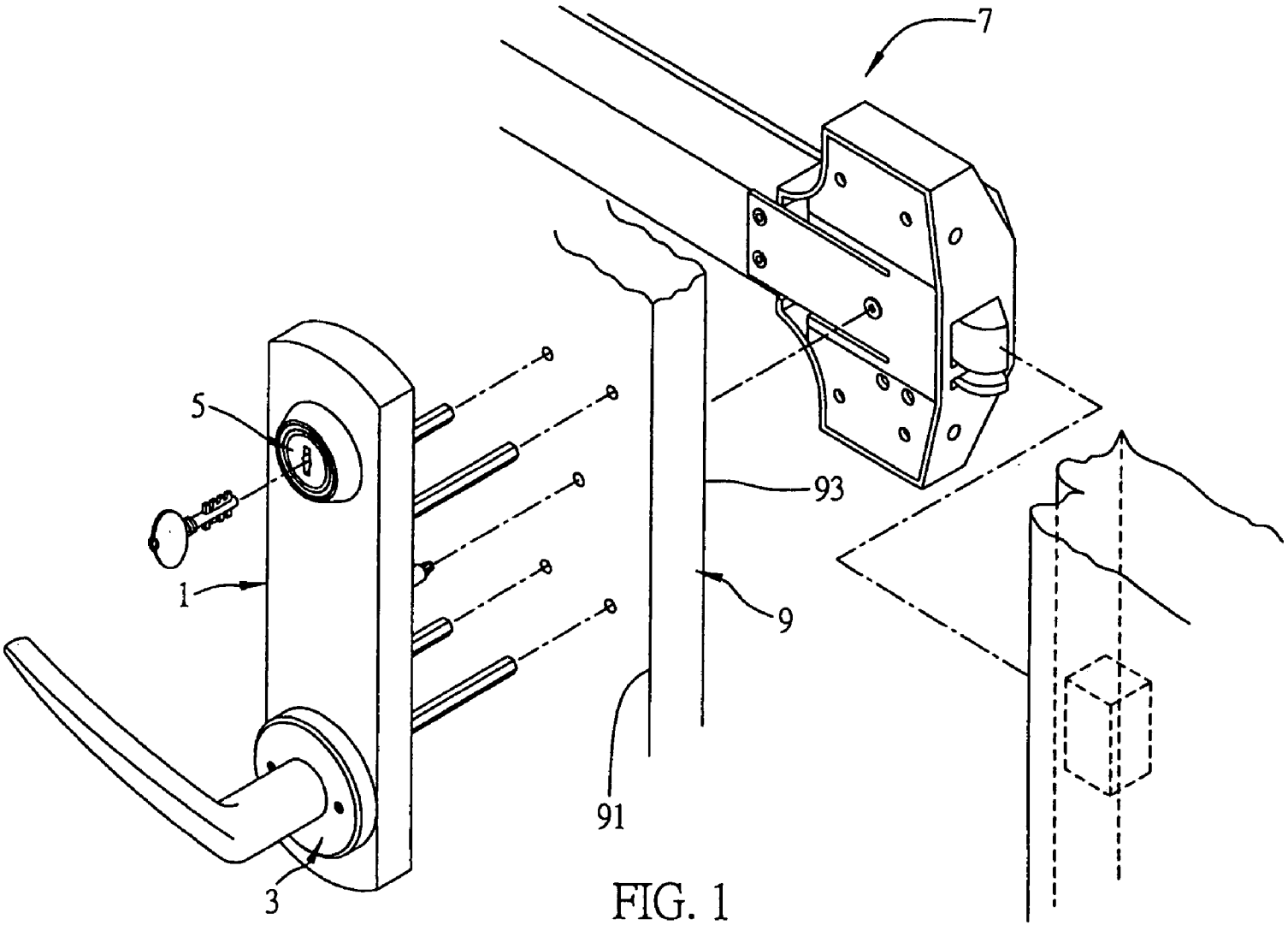
FIG. 1 is a perspective view showing a door lock transmission mechanism according to the present invention assembled to a fire-blocking door lock and a door.

FIG. 1 to FIG. 6 shows the first embodiment of the door lock transmission mechanism according to the present invention. Referring to FIG. 1, the door lock transmission mechanism according to the present invention mainly comprises a door lock casing unit 1, an actuation mechanism 3, and a locking mechanism 5. It should be noted that this embodiment of the door lock transmission mechanism of the present invention is described with an example in which the door lock transmission mechanism is assembled to a door 9 with a fire-blocking door lock 7. As shown in the drawing, the door lock transmission mechanism according to the present invention is installed on the first surface 91 of the door 9, for transmitting movement to the door lock 7 mounted on the second surface 93 of the door 9 opposite to the first surface 91.

The present invention can be applied to both the conventional fire-blocking door lock and door without changing the structure thereof. Therefore, for simplifying the present invention and making the features and the structure of the door lock transmission mechanism according to the present invention more apparent, only the structures of the fire-blocking door lock and the door which is directly connected to the door lock transmission mechanism are shown, while the other portions of the structures are ignored. The same or similar components in the attached drawings are denoted with the same reference numerals.

Figure 2:
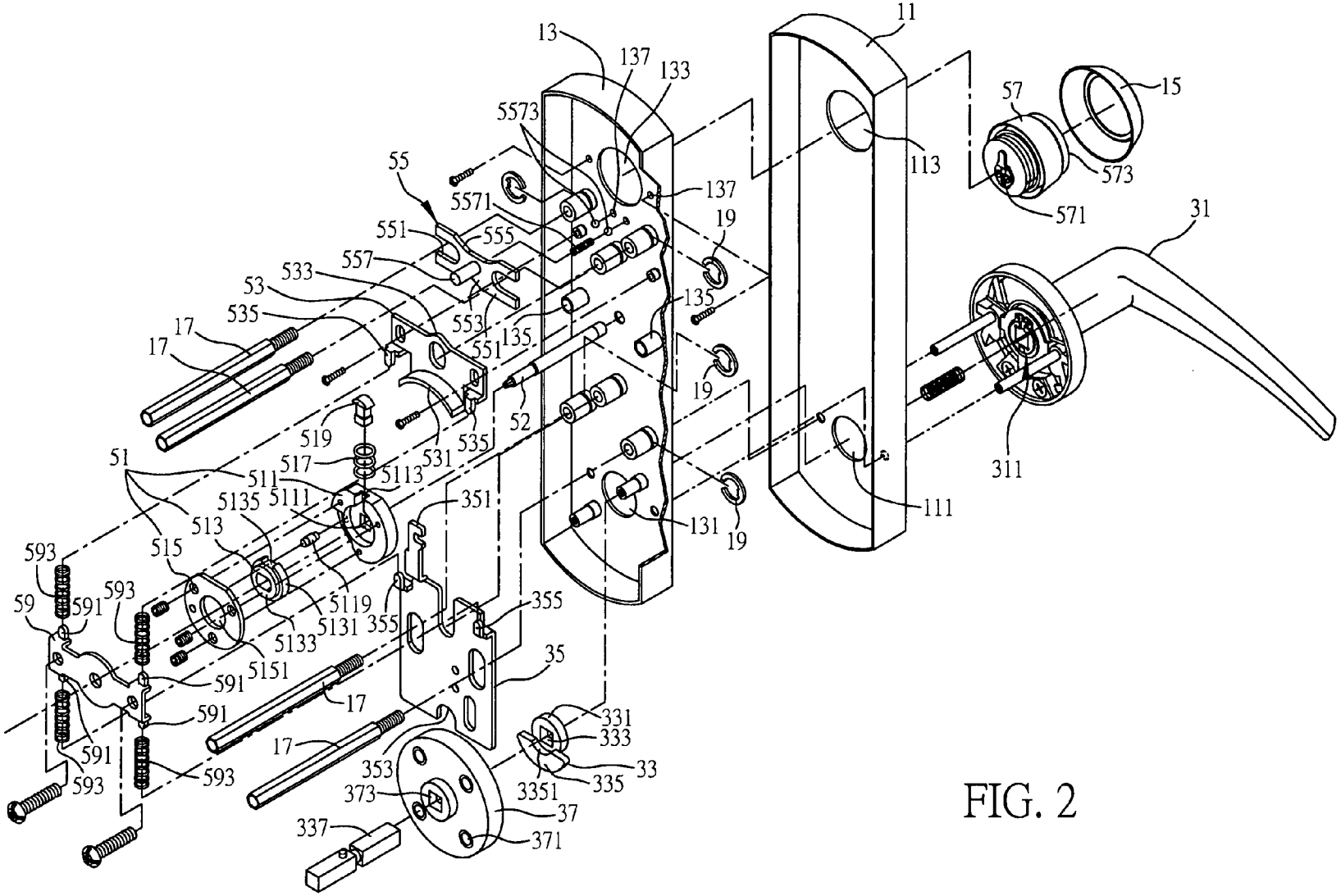
FIG. 2 is an exploded perspective view of an entire door lock transmission mechanism according to the first embodiment of the present invention.

The door lock casing unit 1 is provided on the first surface 91 of the door 9. As shown in FIG. 2, the door lock casing unit 1 mainly comprises a panel 11 and a base frame 13 fitted within the panel 11. First openings 111, 131 and second openings 113, 133 are formed respectively on the panel 11 and the base frame 13 in the corresponding positions.

The actuation mechanism 3 mainly comprises an actuation member 31 such as a handle bar, a first actuation swivel table 33, and a traction member 35. The actuation member 31 is provided outside the door lock casing unit 1 and at least comprises an actuation portion 311. The actuation portion 311 is connected with a later-described actuation bolt from inside of the door lock casing unit 1 through the first openings 111, 131.

The first actuation swivel table 33 is provided inside the door lock casing unit 1. The first actuation swivel table 33 comprises a base seat 331 which is substantially round, a rectangular hole 333 formed in the base seat 331, and a semilunar actuation block 335 extending upwardly from a surface of the base seat 331. An actuation bolt 337 is inserted through the rectangular hole 333 to be connected to the actuation member 31 such that the first actuation swivel table 33 is actuated by the actuation portion 311 of the actuation member 31. The semilunar actuation block 335 has a depression 3351. The traction member 35 partially covers the first actuation swivel table 33, and is driven by the semilunar actuation block 335 of the first actuation swivel table 33. The traction member 35 comprises a traction portion 351, a depression 353, and a pair of extension portions 355. The traction portion 351 which extends from one end of the traction member 35 is substantially hooked shape. The depression 353 is on the other end of the traction member 35 from the traction portion 351, and the actuation bolt 337 can stick out from the depression 353 while the traction member 35 covers the first actuation swivel table 33, such that the actuation bolt 337 is restricted by the depression 353 of the traction member 35 and the depression 3351 of the semilunar actuation block 335. Each of the extension portions 355 extends upwardly respectively from the same end of the traction member 35 with the traction portion 351, and bends toward the traction portion 351.

The actuation unit 3 can further comprise a second actuation swivel table 37. The second actuation swivel table 37 comprises: a plurality of first through holes 371, into which the pins located on the base frame 13 are inserted to fix the second actuation swivel table 37 to the base frame 13; and a second through hole 373 for inserting the actuation bolt 337, wherein the central projection portion of the second actuation swivel table 37 can swivel (rotate) freely with respect to the other portion, so that the central projection portion of the second actuation swivel table 37 can be actuated by pressing the actuation member 31. The second actuation swivel table 37 can be the swivel cable disclosed in Taiwan Patent No. 572102, by which the installation direction of the actuation member 31 such as a handle bar can be changed easily. Because the structure of the second actuation swivel table 37 is known as prior art, it is not further illustrated and described. Moreover, the second actuation swivel table 37 is eliminated in other drawings for simplifying the drawings.

Figure 3A:
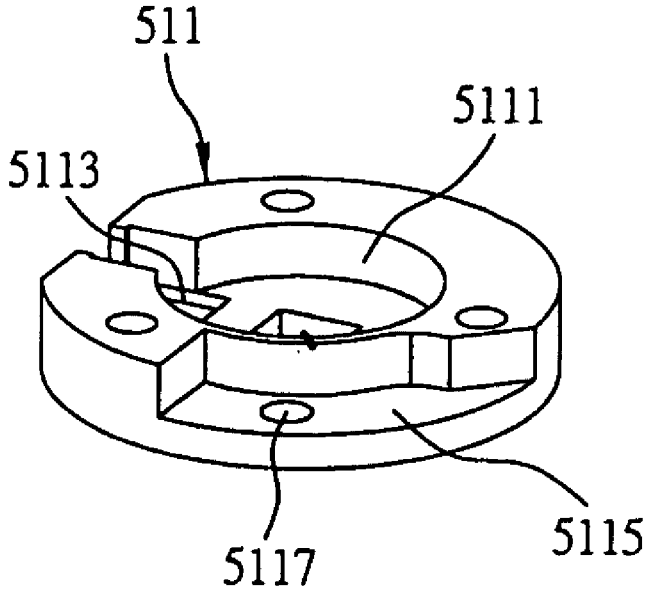
FIGS. 3A and 3B illustrate a locking seat according to the first embodiment of the present invention.
Figure 3B:
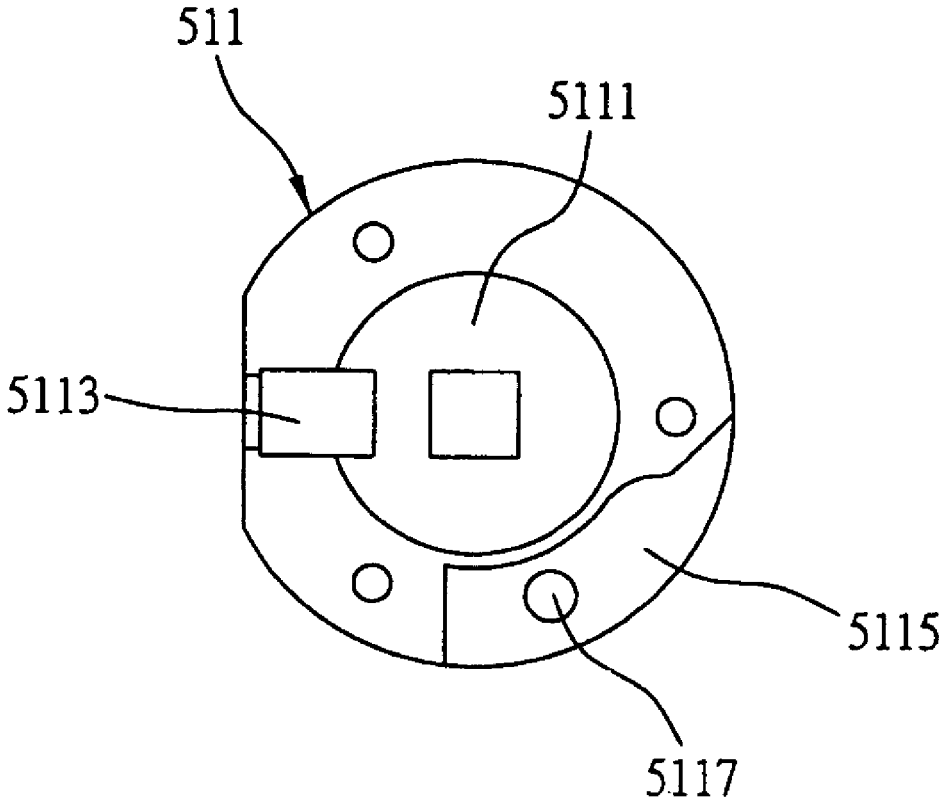

The locking mechanism 5 comprises a core unit 51, a locking plate 53, a lock barrel driving plate 55, and a lock barrel 57. The core unit 51 is provided near one side of the traction member 35 away from the first actuation swivel table 33, and is connected to the door lock 7 for driving the door lock 7. Since the connecting and driving method of the door lock 7 is known as prior art, it is not further illustrated and described herein. The core unit 51 at least comprises a locking seat 511, a swivel block 513, and a cover 515. The locking seat has a holding pit 5111, a holding groove 5113 connecting to the holding pit 5111, a stepped portion 5115 provided in one side of the holding pit 5111, and a pin hole 5117 formed in the stepped portion 5115, as shown in FIG. 3A and FIG. 3B. The holding groove 5113 is partially cut into the holding pit 5111 (as shown in FIG. 3A), and the depth of the holding groove 5113 is deeper than the holding pit 5111 (as shown in FIG. 3B). Furthermore, the pin hole 5117 is for containing a push pin 5119 caught with the traction portion 351, so that the swivel block 513 of the core unit 51 can be rotated by the traction portion 351 while the actuation mechanism 3 is subjected to force. The swivel block 513 has a first swivel portion 5131 which can be held within the holding pit 5111, a second swivel portion 5133 steppedly connecting the first swivel portion 5131, and a notch 5135 formed in a radial direction on the periphery of the first swivel portion 5131. The cover 515 has an opening 5151 for containing the second swivel portion 5133.

While assembling the core unit 51, the swivel block 513 can be initially attached to the locking seat 511, and an elastic member 517 and a movable catch block 519, which is arrowhead-shaped for example, are put into the holding groove 5113 and the notch 5135 in sequence, and then the cover 515 is fixed to the locking seat 511 by several fixing members such as screw. By this way, the swivel block 513 can be hold between the cover 515 and the locking seat 511.

Meanwhile, since the holding groove 5113 is partially cut into the holding pit 5111, and the depth of the holding groove 5113 is deeper than the holding pit 5111, after putting the elastic member 517 and the movable catch block 519 into the holding groove 5113 in sequence, the movable catch block 519 does not catch the notch 5135 of the swivel block 513 while the elastic member 517 and the movable catch block 519 are nor depressed, so that the locking seat 511 can rotate freely with respect to the swivel block 513. On the other hand, while the elastic member 517 and the movable catch block 519 are depressed, the movable catch block 519 catches the notch 5135 of the swivel block 513, so that the swivel block 513 is fixed with the locking seat 511.

By this way, the swivel block 513 can catch the locking seat 511 with the elastic member 517 and the movable catch block 519 in a retractable way. The locking mechanism 5 further comprises a shaft 52. The shaft 52 penetrates through the core unit 51 and is fixed onto it. One end of the shaft 52 is inserted into a hole of the base frame 13. While the movable catch block 519 catches in the notch 5135 of the swivel block 513, the swivel block 513 can be rotated to drive the shaft 52 to rotate to open the door lock 7. The end of the shaft 52 for connecting the door lock 7 can be selected to have a crisscross structure.

The locking plate 53 provided in one side of the core unit 51 away from the traction member 35 has a push portion 531 extending upwardly, a driven bulge 533 opposite to the push portion 531, and a pair of extension portions 535 on the same side with the push portion 531. The lock barrel driving plate 55 provided in one side of the locking plate 53 away from the core unit 51 is for driving the locking plate 53. It can be selected to provide, for example, bifurcating portions 551 in both of the shorter side of the lock barrel driving plate 55, for restricting the moving of the lock barrel driving plate 55 within a certain range. The lock barrel driving plate 55 can also have a first depression 553 corresponding to the driven bulge 533 for example, and a second depression 555 corresponding to the lock barrel 57 for example (it will be described later), wherein the first depression 553 can be selected to have a V-shaped structure, and the second depression 555 can be selected to have an U-shaped structure.

Meanwhile, a sleeve 557 is provided in the center between the bifurcating portions 551, the first depression 553, and the second depression 557. An elastic member 5571 is provided within the portion of the sleeve 553 facing the base frame 13, and two holes for containing rolling members 5573 are provided on corresponding positions of the base frame 13, such that the lock barrel driving plate 55 can be elastically positioned by the elastic member 5571 and the rolling members 5573.

The lock barrel 57 is inserted through the second openings 113 and 133, and is inserted into the inside of the lock casing unit 1. The lock barrel 57 also has a pushing plate 571 for pushing the lock barrel driving plate 55 to move laterally about the locking plate 53 for pushing the second depression 555 of the lock barrel driving plate 55. The lock barrel 57 can also be covered by a lock barrel stand 15, and only the lock barrel head 573 thereof is exposed. Because the structure and the function of the lock barrel 57 is known as prior art, it is not further illustrated and described herein. Meanwhile, it should be understood that the lock barrel 57 in the present invention can also be another type of lock barrel other than the lock barrel described in this embodiment.

The core unit 51 can also be fixed onto the inside of the lock casing unit 1 by a core fixing plate 59. There are four extension portions 591 provided in the core fixing plate 59, such that one end of each elastic members 593 can be mounted on each of the extension portions 591, while the other end of those elastic members 593 can be mounted on each of the extension portions 355 of the traction member 35 and each of the extension portions 535 of the locking plate 53 respectively.

Figure 4:
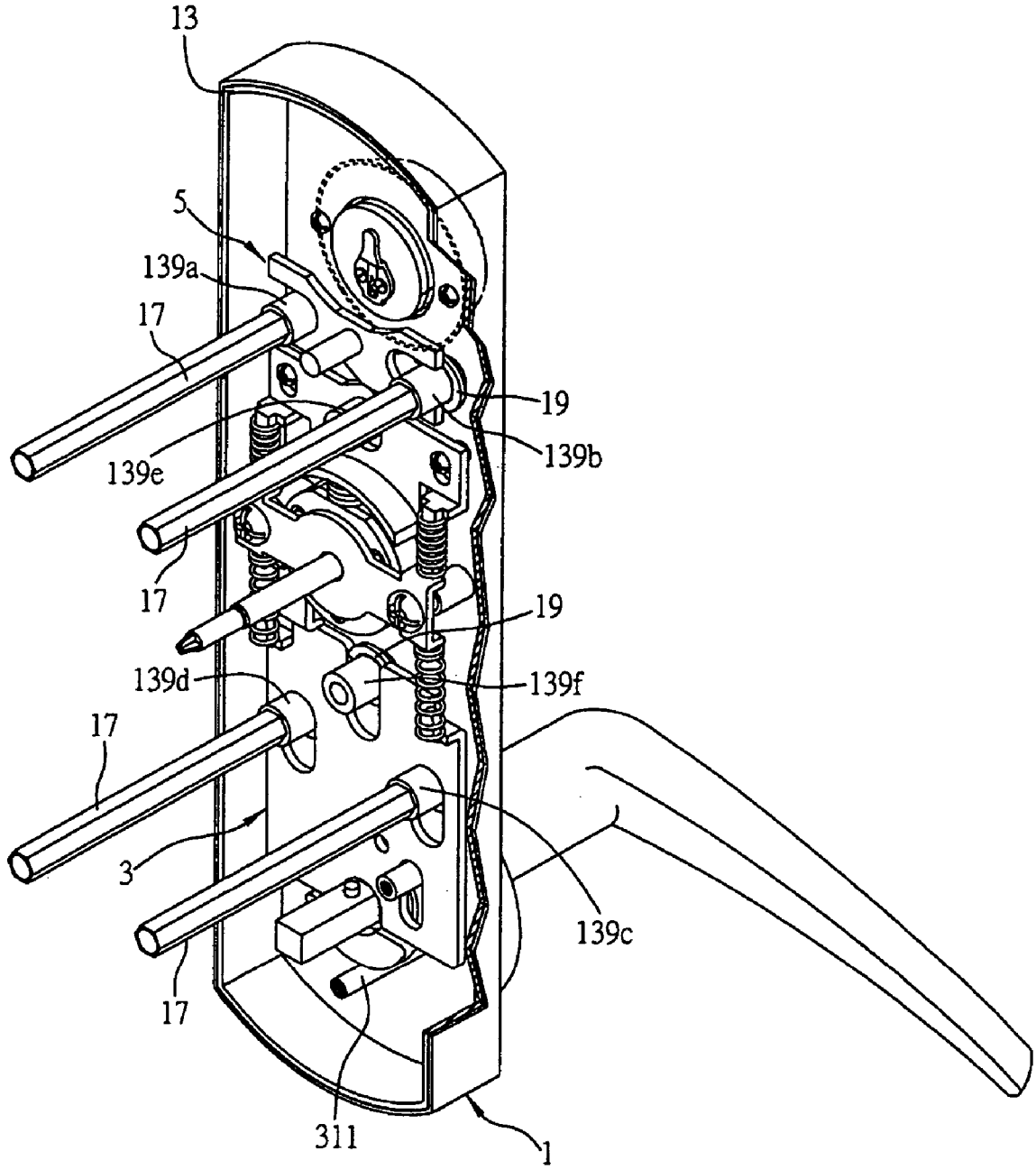
FIG. 4 is a perspective view of an assembled door lock transmission mechanism according to the first embodiment of the present invention.

After assembling the lock casing unit 1, the actuation mechanism 3, and the locking mechanism 5 in sequence, the result is shown as FIG. 4. In the door lock transmission mechanism according to this embodiment, the base frame 13 of the lock casing unit 1 is connected to the door lock 7 by four assembling rods 17 screwed onto the four tacking studs 139*a*, 139*b*, 139*c*, 139*d* on the base frame 13. However, in other embodiments, the base frame 13 of the lock casing unit 1 can also be connected to the door lock 7 by two assembling rods 139*e*, 139*f* on the base frame 13 in order to be adapted to other kind of door locks while fulfilling the requirement of the relative rules. In other words, the door lock transmission mechanism according to the present invention has a flexible design and can be adapted to various kinds of door locks. In the door lock transmission mechanism according to the present invention, the traction member 35 is movably mounted onto the base frame 13 of the lock casing unit 1 by the tacking studs 139*c* and 139*d*. E-shaped retaining rings 19 can be further provided on each of the tacking studs 139*a*, 139*b*, 139*c*, 139*d*, 139*e*, and 139*f*. In this embodiment, the bifurcating portions 551 are inserted between the two tacking studs 139*a* and 139*b* inside the lock casing unit 1, and thereby the lock barrel driving plate 55 is restricted to a certain range of the movement by these tacking studs 139*a* and 139*b*.

Figure 5:
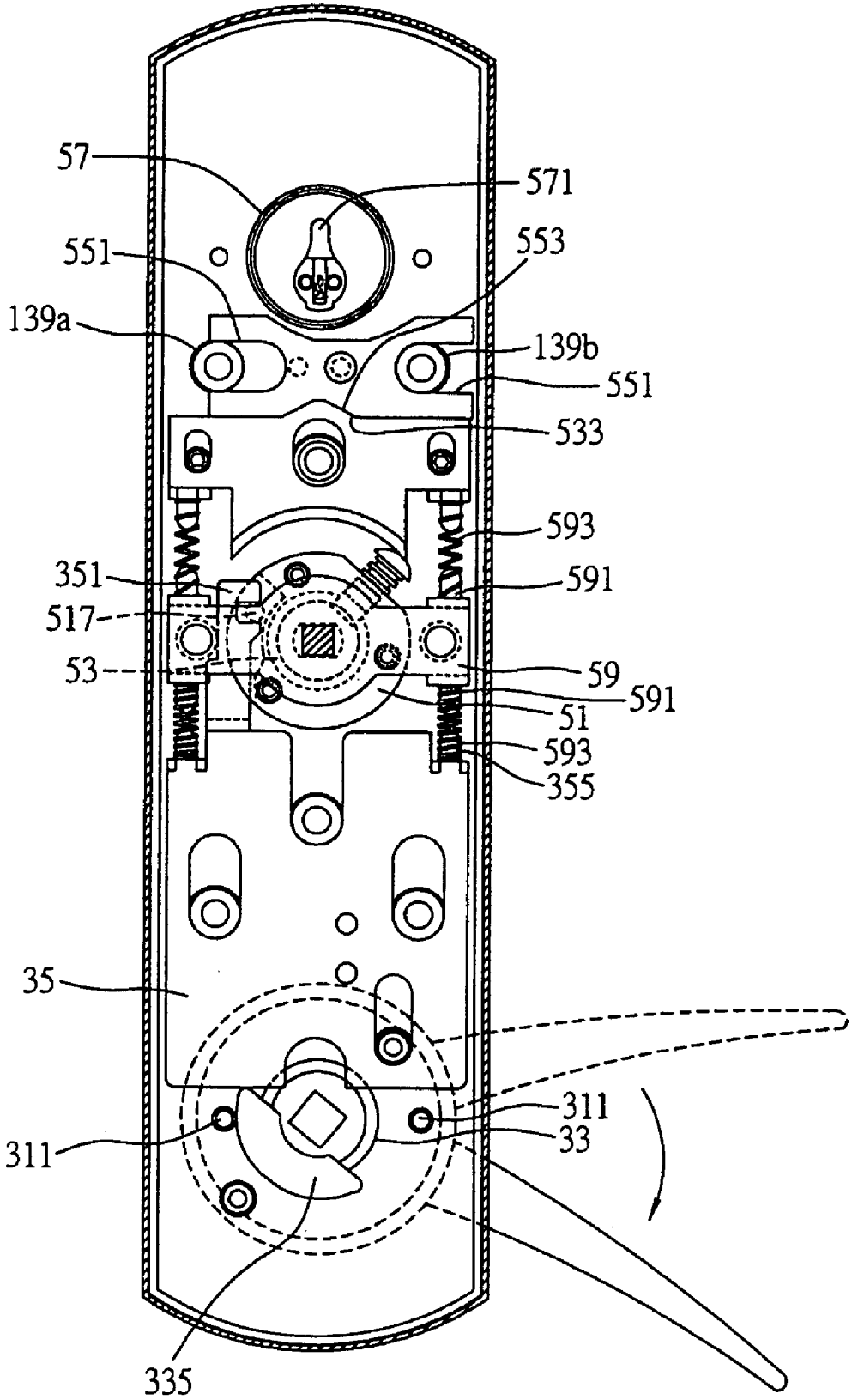
FIG. 5 illustrates an operational state of a door lock transmission mechanism according to the first embodiment of the present invention.

While the locking mechanism is locked, as shown in FIG. 5, the driven bulge 533 is inset into the first depression 553. Because the traction portion 351 of the traction member 35 catches in the push pin 5119, the actuation portion 335 of the first actuation swivel table 33 pushes the traction member 35 toward the core unit 51 while the actuation member 31 is actuated, and hence the locking seat 511 of the core unit 51 is rotated, and the actuation member 31 can be pressed down by force. In this situation, since the shaft 52 does not rotate while the locking seat 511 rotates freely with respect to the swivel block 513 that is fixed with the shaft 52, the locking state of the door lock 7 is not released.

Meanwhile, because there are elastic members 593 set between the extension portions 355 of the traction member 35 and the extension portions 591 of the core fixing plate 59, the elastic recovery energy of the elastic members 593 is stored to be able to drive the traction member 53 back to its original position in which the traction member 53 is not pushed by the actuation portion 335 of the first actuation swivel table 33 when the traction member 35 is pushed toward the core unit 51.

Figure 6:
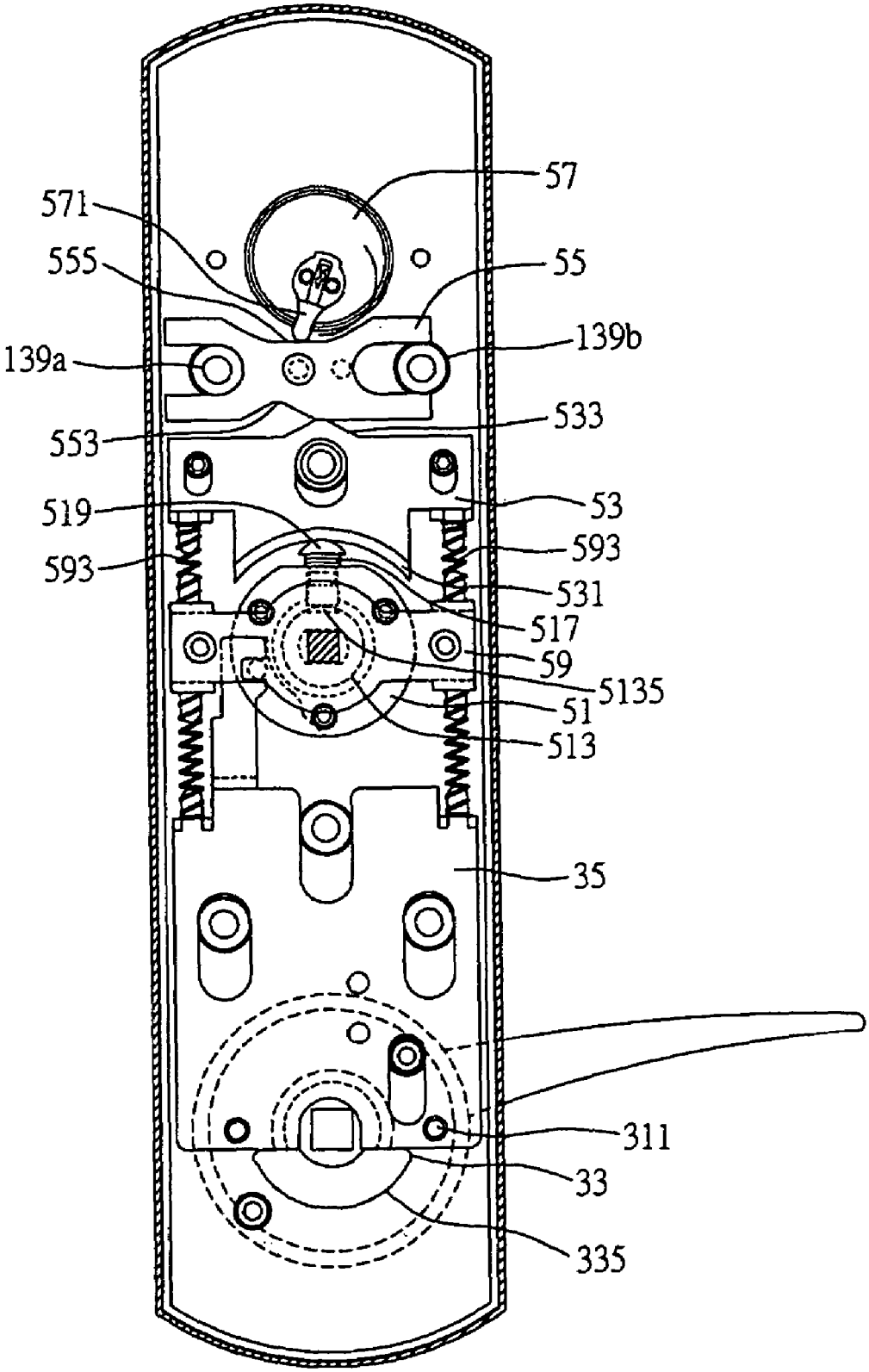
FIG. 6 illustrates another operational state of a door lock transmission mechanism according to the first embodiment of the present invention.

While the locking mechanism is not locked, as shown in FIG. 6, the lock barrel driving plate 55 is driven to move from the tacking stud 139*b* towards the tacking stud 139*a* and to make the first depression 553 thereof to depart from the driven bulge 533, and hence to push the locking plate 53 to move towards the core unit 51 to an unlocked position. As a result, the movable catch block 519 provided with the elastic member 517 is pressed by the push portion 531 of the locking plate 53 to descend to catch in the notch 5135 of the swivel block 513. In this situation, since the swivel block 513 which is fixed with the shaft 52 is caught with the locking seat 511, the shaft 52 can be rotated by the locking seat 511 to release the locking state of the door lock 7.

From the foregoing description, while the locking mechanism is locked, the movable catch block 519 does not catch in the notch 5135 of the swivel block 513. Therefore, when actuating the actuation member 31, the locking seat 511 rotates freely with respect to the swivel block 513, and hence the shaft 52 does not rotate. As a result, the actuation member 31 can be pressed down by force, without releasing the locking state of the door lock 7. On the other hand, while the locking mechanism is unlocked, the movable catch block 519 catches in the notch 5135 of the swivel block 513. Therefore, when actuating the actuation member 31, the locking seat 511 rotates with the shaft 52 simultaneously.

Accordingly, the drawbacks of the conventional door lock transmission mechanism, such as the problems of increased maintenance, poor operation and increased cost caused by the issues that the inner parts of the door lock transmission mechanism are easily damaged because the handle bar or the push plate can not be pressed down by force while the locking mechanism is locked, can be resolved, and the drawbacks of the prior art, such as the problems that the operational efficiency is influenced by the failure of parts and the user is endangered, can also be avoided.

Moreover, because there are elastic members 593 provided between the extension portions 535 of the locking plate 53 and the extension portions 591 of the core fixing plate 59, the elastic recovery energy of these elastic members 593 can be stored when the locking plate 53 is pushed towards the core unit 51. Therefore, while the lock barrel driving plate 55 has been forced to move from the tacking stud 139*a* towards tacking stud 139*b*, the locking plate 53 can be pushed to move back to its original position in which the locking plate 53 is not pushed by the lock barrel driving plate 55.

Furthermore, in the present invention, there are elastic members 5571 provided inside the sleeve 557 and the corresponding rolling members 5573 provided in the holes of the base frame 13. By those elastic members 5571 and rolling member 5573, the lock barrel driving plate 55 can be elastically positioned between the tacking studs 139*a* and 139*b*.

Second Embodiment

FIG. 7 to FIG. 10 illustrate the second embodiment of the door lock transmission mechanism of the present invention. The function of the door lock transmission mechanism according to this embodiment is similar to that according to the pervious embodiment, and hence only the differing structure and function are described, omitting the description of alike features, in order to make the features and advantages of the present invention more apparent. Similar or same components are denoted with similar or same reference numerals.

Figure 7:
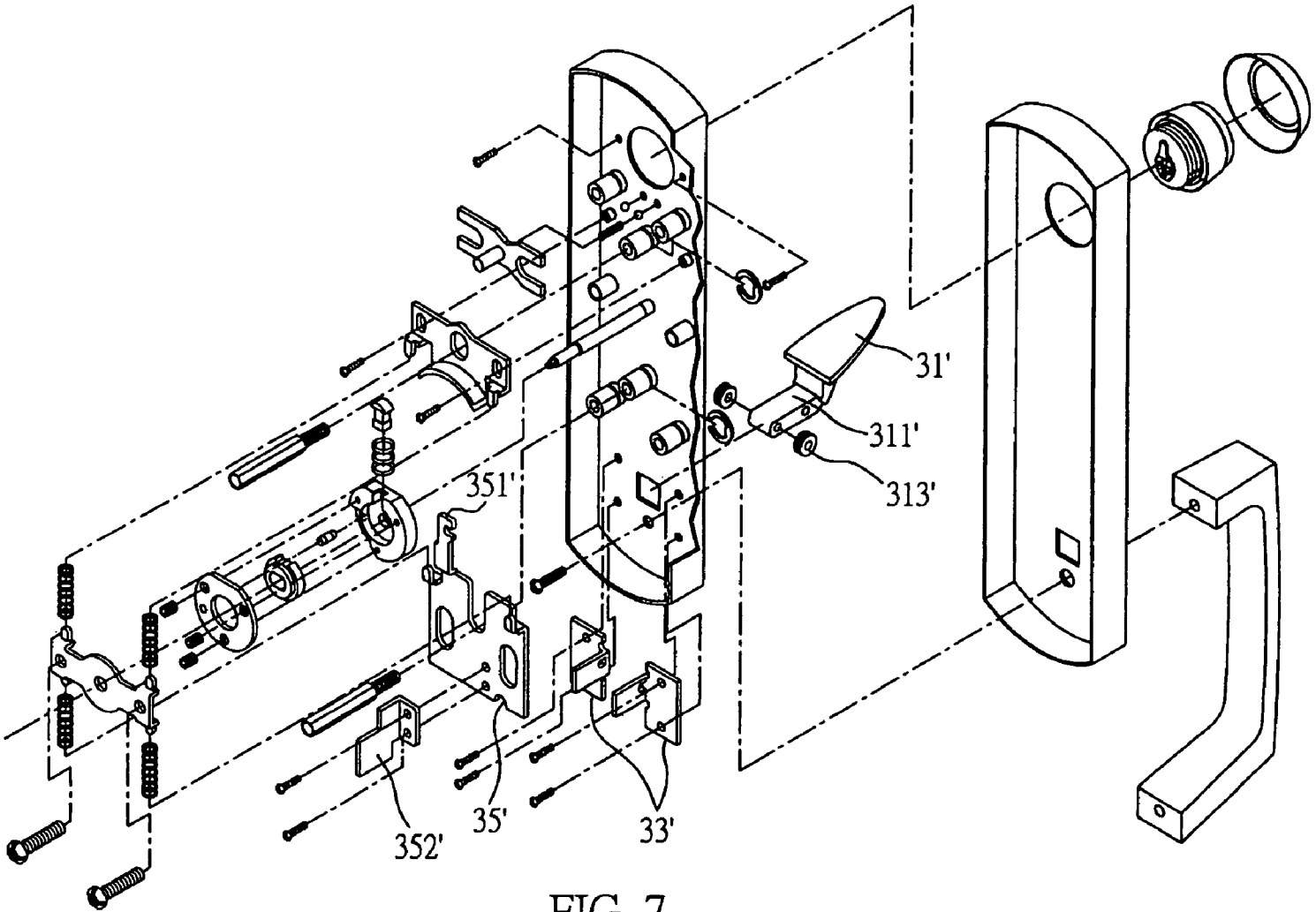
FIG. 7 is an exploded perspective view of an entire door lock transmission mechanism according to the second embodiment of the present invention.
Figure 8:
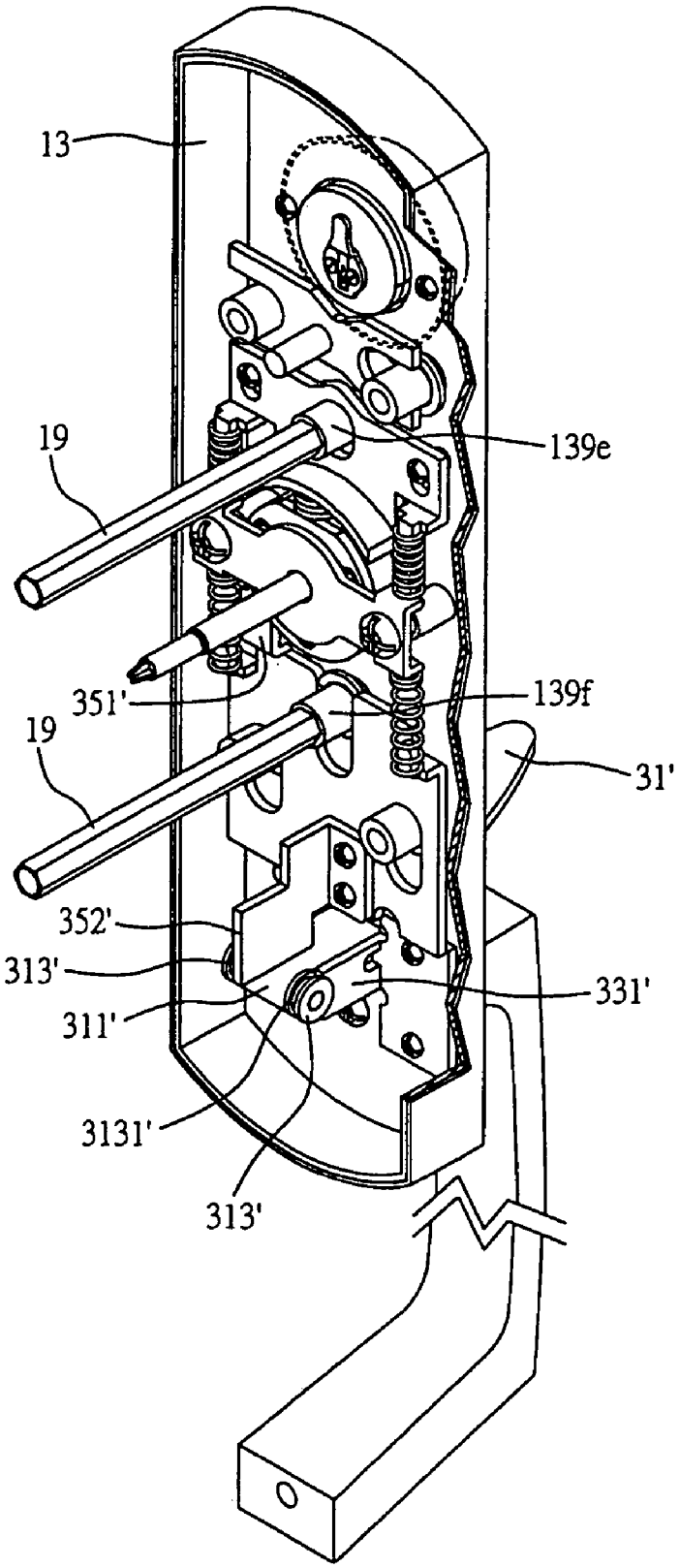
FIG. 8 is a perspective view of an assembled door lock transmission mechanism according to the second embodiment of the present invention.

As shown in FIG. 7, the key differences between this embodiment and the foregoing first embodiment is that the actuation mechanism 3 comprises an actuation member 31' such as a push plate, a pair of fixing pieces 33', and a traction member 35'. As shown in FIG. 8, the two sides of the actuation portion 311' of the actuation member 31' are connected to a pair of pivot pins 313'. Each of the pivot pins 313' has a ring groove 3131' by which the actuation portion 311' can catch in the fixing portions 331' of the pair of the fixing pieces 33' in a rotatable way. There is a transmission portion 352' provided in the traction member 35'. The traction portion 352' can be selected to have an L-shaped structure, such that the transmission portion 352' is actuated by the actuation portion 311' to move the traction member 35' towards the core unit 51 after the actuation member 31' is pressed. The structure of each fixing portions 331' is perpendicular to the base frame 13 and extends upwardly. The traction member 35 in the first embodiment is replaced by the pair of fixing pieces 33', and the traction member 35' and the first actuation swivel table 33 in the first embodiment are not present in this embodiment.

It should be noted that, though two pivot pins 313' separated from the actuation portion 311' are illustrated in this embodiment, the pivot pins 313' can also be formed as a unit with the actuation end 311' and are not restricted to those shown in this embodiment. Moreover, according to this embodiment, the base frame 13 of the lock casing unit 1 of the door lock transmission mechanism of the present invention is fixed to the door lock 7 by two assembling rods 17 screwed onto two tacking studs 139*e* and 139*f* on the base frame 13.

Figure 9:
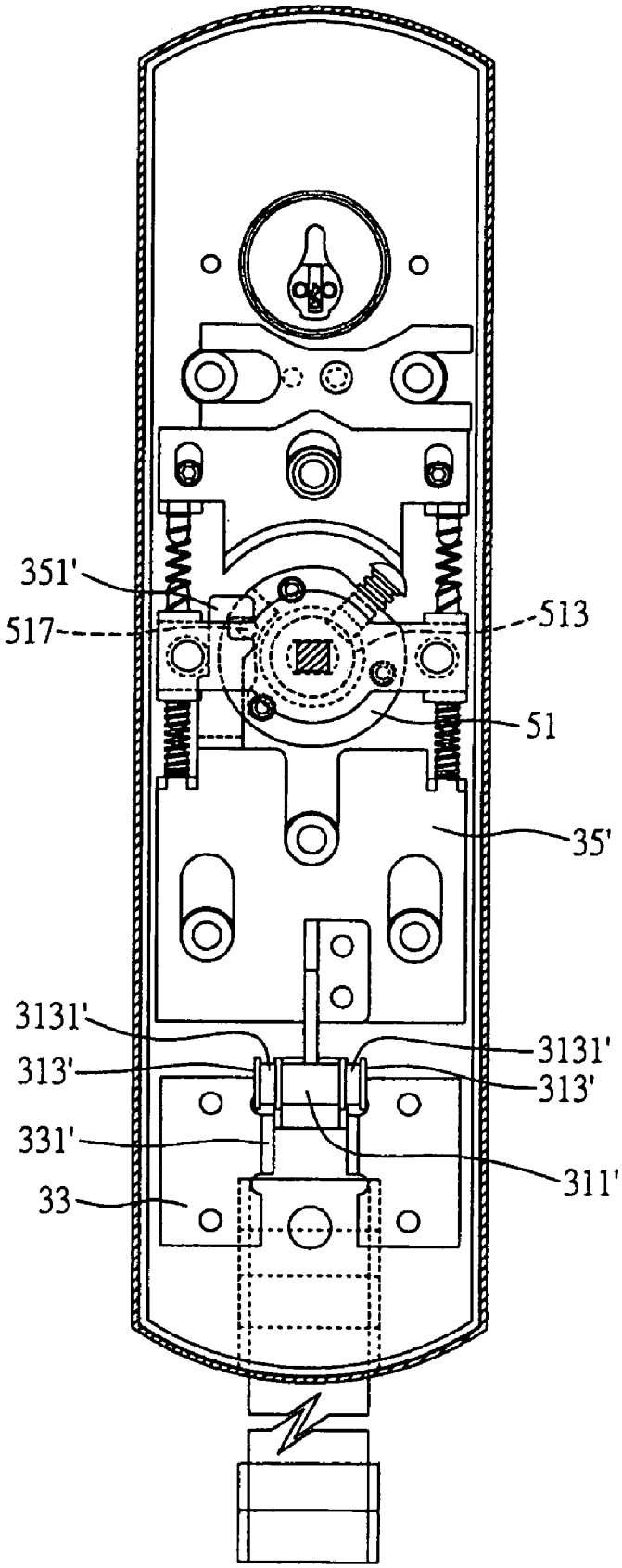
FIG. 9 illustrates an operational state of a door lock transmission mechanism according to the second embodiment of the present invention.
Figure 10:
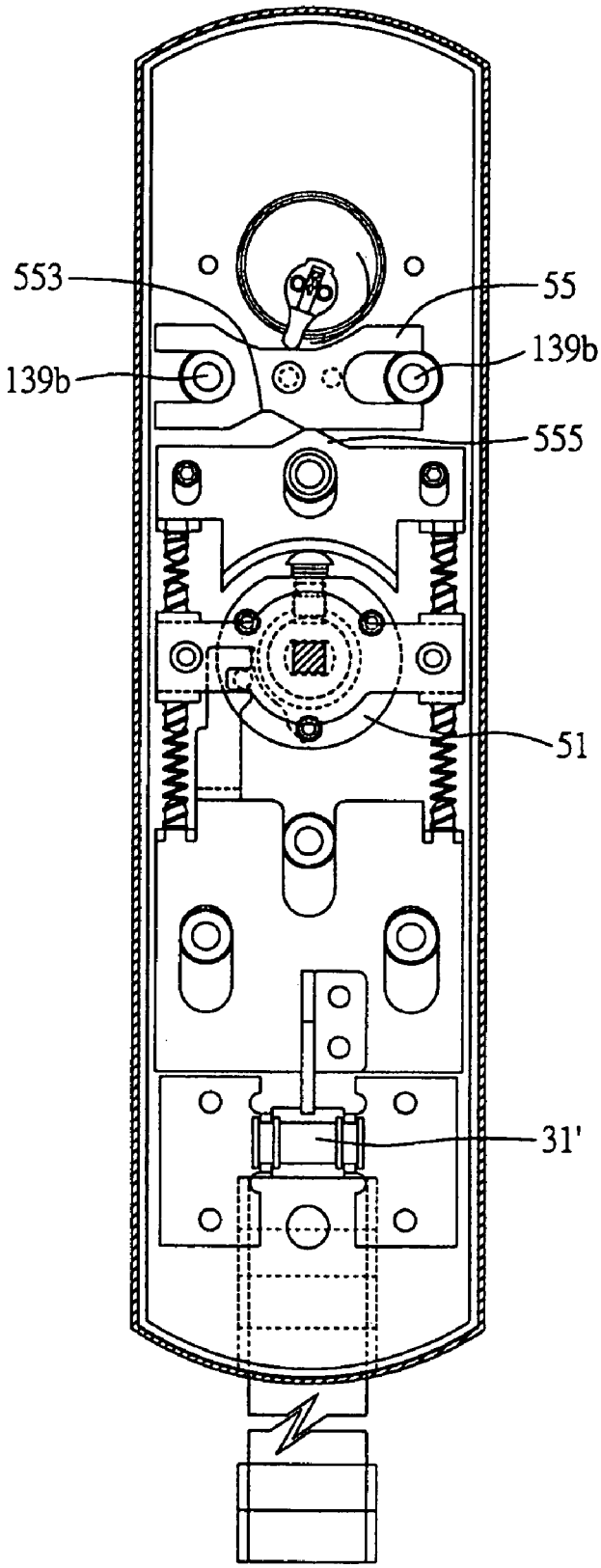
FIG. 10 illustrates another operational state of a door lock transmission mechanism according to the second embodiment of the present invention.

As shown in FIG. 9, while the locking mechanism is locked and the actuation member 31 is actuated, the ring groove 3131' of the pair of pivot pins 313' is rolled to release the catching state between the pair of pivot pins 313' and the pair of fixing pieces 33'. In other words, the actuation portion 311' of the actuation member 31' is actuated to depart from the pair of fixing pieces 33' to move towards the traction member 35', thereby pushing the traction member 35' to move towards the core unit 51, and hence the locking seat 511 of the core unit 51 is rotated since the traction portion 351' of the traction member 35' catches in the push pin 5119. In this situation, the locking seat 511 rotates freely with respect to the swivel block 513 which is fixed with the shaft 52, and the shaft 52 does not rotate. Accordingly, the actuation member 31' can be pressed down by force without releasing the locking state of the door lock 7. Thereby the problems of the conventional techniques can be solved by this embodiment.

Conversely, while the locking mechanism is not locked, the lock barrel driving plate 55 is driven to move from the tacking stud 139*b* towards the tacking stud 139*a* to make the first depression 553 thereof to depart from the driven bulge 533, and hence to push the locking plate 53 to move towards the core unit 51 to an unlocked position. In this situation, the ring groove 3131' of the pair of pivot pins 313' return to the catching state with the pair of fixing pieces 33'.

It should be apparent to those skilled in the art that the above description is only illustrative of specific embodiments and examples of the present invention. The present invention should therefore cover various modifications and variations made to the herein-described structure and operations of the present invention, provided they fall within the scope of the present invention as defined in the following appended claims.

What is claimed is:

1. A door lock transmission mechanism provided on a first surface of a door, for driving a door lock provided on a second surface of the door opposite to the first surface, the door lock transmission mechanism comprising:

a lock casing unit provided on the first surface of the door;

an actuation mechanism, which comprises an actuation member provided outside the lock casing unit and having an actuation portion thereof inserted into the lock casing unit, a swivel table provided inside the lock casing unit and driven by the actuation portion, and a traction member partially covering the swivel table and driven by the swivel table, wherein the traction member comprises a traction portion having substantially a hook shape and extended from a side of the traction member, a depression disposed on a side of the traction member opposite to the side the traction portion, and two extension portions provided on the side of the traction member having the traction portion and extended upwardly and perpendicularly to the side of the traction member; and a locking mechanism, which comprises a core unit provided on a side of the traction member relatively away from the swivel table and comprising a swivel block and a locking seat for retractably catching the swivel block, a locking plate connected to a side of the core unit relatively away from the traction member by an elastic member, a lock barrel driving plate provided on a side of the locking plate relatively away from the core unit and for pushing the locking plate, and a lock barrel inserted into the lock casing unit and for driving the lock barrel driving plate to move away from the side of the locking plate, wherein the swivel block is caught by the locking scat so as to release the door lock when the locking mechanism is unlocked, and when the locking mechanism is locked, the swivel block is free of being caught by the locking seat, and the locking seat is free to rotate, such that the actuation member is pressed down by force and keeps a locking state of the door lock.

2. The door lock transmission mechanism of claim 1, wherein the lock casing unit comprises a panel and a base frame provided in the panel.

3. The door lock transmission mechanism of claim 2, wherein the base frame comprises a plurality of tacking studs for screwing assembling rods to connect the lock casing unit to the door lock.

4. The door lock transmission mechanism of claim 1, wherein the actuation member is a handle bar.

5. The door lock transmission mechanism of claim 1, wherein the core unit further comprises a cover; the locking sear comprises a holding pit, a holding groove connected to the holding pit, a stepped portion provided on a side of the holding pit, and a pin hole formed in the stepped portion; the swivel block comprises a first swivel portion held in the holding pit, a second swivel portion steppedly connected to the first swivel portion, and a notch formed in a radial direction on periphery of the first swivel portion; and the cover comprises an opening for receiving the second swivel portion, such that an elastic member and a movable catch block are in sequence placed in the holding groove and the notch.

6. The door lock transmission mechanism of claim 5, wherein the holding groove cuts into part of the holding pit, and the holding groove is deeper than the holding pit; and the pin hole is for receiving a push pin that is for catching the traction portion.

7. The door lock transmission mechanism of claim 1, wherein the locking plate comprises a push portion provided on a side thereof and extended upwardly, a driven bulge provided on a side of the locking plate opposite to the side having the push portion, and two extension portions provided on the side of the locking plate having the push portion.

8. The door lock transmission mechanism of claim 1, wherein the lock barrel driving plate comprises bifurcating portions provided on two relatively shorter sides thereof respectively for restricting movement of the lock barrel driving plate within a predetermined range, and a first depression and a second depression provided on two relatively longer sides of the lock barrel driving plate respectively.

9. The door lock transmission mechanism of claim 1, wherein the core unit further comprises a core fixing plate fixed inside the lock casing unit, the core fixing plate having a plurality of extension portions for disposing elastic members thereon.

10. A door lock transmission mechanism provided on a first surface of a door, for driving a door lock provided on a second surface of the door opposite to the first surface, the door lock transmission mechanism comprising:

a lock casing unit provided on the first surface of the door;

an actuation mechanism, which comprises an actuation member provided outside the lock casing unit and having an actuation portion thereof inserted into the lock casing unit, a swivel table provided inside the lock casing unit and driven by the actuation portion, and a traction member partially covering the swivel table and driven by the swivel table, wherein the traction member is formed with a traction portion; and a locking mechanism, which comprises a core unit provided on a side of the traction member relatively away from the swivel table and comprising a swivel block and a locking seat for retractably catching the swivel block, a locking plate connected to a side of the core unit relatively away from the traction member by an elastic member, a lock barrel driving plate provided on a side of the locking plate relatively away from the core unit and for pushing the locking plate, and a lock barrel inserted into the lock casing unit and for driving the lock barrel driving plate to move away from the side of the locking plate, wherein the swivel block is caught by the locking seat so as to release the door lock when the locking mechanism is unlocked, and when the locking mechanism is locked, the swivel block is free of being caught by the locking seat, and the locking scat is free to rotate, such that the actuation member is pressed down by force and keeps a locking state of the door lock, wherein the lock barrel driving plate comprises bifurcating portions provided on two relatively shorter sides thereof respectively for restricting movement of the lock barrel driving plate within a predetermined range, and a first depression and a second depression provided on two relatively longer sides of the lock barrel driving plate respectively.

11. The door lock transmission mechanism of claim 10, wherein the lock casing unit comprises a panel and a base frame provided in the panel.

12. The door lock transmission mechanism of claim 11, wherein the base frame comprises a plurality of tacking studs for screwing assembling rods to connect the lock casing unit to the door lock.

13. The door lock transmission mechanism of claim 10, wherein the actuation member is a handle bar.

14. The door lock transmission mechanism of claim 10, wherein the traction member comprises the traction portion having substantially a hook shape and extended from a side of the traction member, a depression disposed on a side of the traction member opposite to the side having the traction portion, and two extension portions provided on the side of the traction member having the traction portion and extended upwardly and perpendicularly to the side of the traction member.

15. The door lock transmission mechanism of claim 10, wherein the core unit further comprises a cover; the locking seat comprises a holding pit, a holding groove connected to the holding pit, a stepped portion provided on a side of the holding pit, and a pin hole formed in the stepped portion; the swivel block comprises a first swivel portion held in the holding pit, a second swivel portion steppedly connected to the first swivel portion, and a notch formed in a radial direction on periphery of the first swivel portion; and the cover comprises an opening for receiving the second swivel portion, such that an elastic member and a movable catch block are in sequence placed in the holding groove and the notch.

16. The door lock transmission mechanism of claim 15, wherein the holding groove cuts into part of the holding pit, and the holding groove is deeper than the holding pit; and the pin hole is for receiving a push pin that is for catching the traction portion.

17. The door lock transmission mechanism of claim 10, wherein the locking plate comprises a push portion provided on a side thereof and extended upwardly, a driven bulge provided on a side of the locking plate opposite to the side having the push portion, and two extension portions provided on the side of the locking plate having the push portion.

18. The door lock transmission mechanism of claim 10, wherein the core unit further comprises a core fixing plate fixed inside the lock casing unit, the core fixing plate having a plurality of extension portions for disposing elastic members thereon.

19. A door lock transmission mechanism provided on a first surface of a door, for driving a door lock provided on a second surface of the door opposite to the first surface, the door lock transmission mechanism comprising:

a lock casing unit provided on the first surface of the door;

an actuation mechanism, which comprises an actuation member provided outside the lock casing unit and having an actuation portion thereof inserted into the lock casing unit, a swivel table provided inside the lock casing unit and driven by the actuation portion, and a traction member partially covering the swivel table and driven by the swivel table, wherein the traction member is formed with a traction portion; and a locking mechanism, which comprises a core unit provided on a side of the traction member relatively away from the swivel table and comprising a swivel block and a locking seat for retractably catching the swivel block, a locking plate connected to a side of the core unit relatively away from the traction member by an elastic member, a lock barrel driving plate provided on a side of the locking plate relatively away from the core unit and for pushing the locking plate, and a lock barrel inserted into the lock casing unit and for driving the lock barrel driving plate to move away from the side of the locking plate, wherein the swivel block is caught by the locking sear so as to release the door lock when the locking mechanism is unlocked, and when the locking mechanism is locked, the swivel block is free of being caught by the locking seat, and the locking seat is free to rotate, such that the actuation member is pressed down by force and keeps a locking state of the door lock, wherein the core unit further comprises a cover; the locking seat comprises a holding pit, a holding groove connected to the holding pit, a stepped portion provided on a side of the holding pit, and a pin hole formed in the stepped portion; the swivel block comprises a first swivel portion held in the holding pit, a second swivel portion steppedly connected to the first swivel portion, and a notch formed in a radial direction on periphery of the first swivel portion; and the cover comprises an opening for receiving the second swivel portion, such that an elastic member and a movable catch block are in sequence placed in the holding groove and the notch.

* * * * *